US006086241A

United States Patent [19]

Herr et al.

[11] Patent Number: 6,086,241

[45] **Date of Patent: *Jul. 11, 2000**

[54] COMBINED MIXING AND DEFLECTION UNIT

[75] Inventors: Wolfgang Herr, Hirschaid; Ralf Sigling; Horst Spielmann, both of Baiersdorf, all of Germany

[73] Assignee: Siemens Aktiengesellschaft, Munich, Germany

[ * ] Notice: This patent is subject to a terminal disclaimer.

[21] Appl. No.: 08/273,767

[22] Filed: Jul. 12, 1994

[30] Foreign Application Priority Data

Jul. 14, 1993 [DE] Germany ..... 43 23 541

[51] Int. Cl.[7] ..... B01F 5/00

[52] U.S. Cl. ..... 366/181.5; 366/337

[58] Field of Search ..... 138/37, 39; 366/336, 366/337, 340, 181.5

[56] References Cited

U.S. PATENT DOCUMENTS

| | | | |
|---|---|---|---|
| 385,992 | 7/1888 | Bemis | 138/37 |
| 2,645,463 | 7/1953 | Stearns | 366/340 |
| 2,747,974 | 5/1956 | Felger | 366/340 |
| 3,351,091 | 11/1967 | Chambert | 138/39 |
| 3,820,570 | 6/1974 | Holzhuter | 138/39 |
| 3,831,350 | 8/1974 | Gilles | 138/37 |
| 4,498,786 | 2/1985 | Ruscheweyh | 366/336 |
| 4,786,185 | 11/1988 | Knief | 366/340 |
| 4,981,368 | 1/1991 | Smith | 366/340 |
| 5,362,150 | 11/1994 | Taylor | 366/336 |

FOREIGN PATENT DOCUMENTS

| | | | |
|---|---|---|---|
| 4123161 | 1/1993 | Germany . | |
| 1305403 | 1/1973 | United Kingdom | 366/336 |

OTHER PUBLICATIONS

Soviet Union Patent abstract No. SU 350 626, Apr. 15, 1983.

*Primary Examiner*—Randall E. Chin
*Attorney, Agent, or Firm*—Herbert L. Lerner; Laurence A. Greenberg; Werner H. Stemer

[57] ABSTRACT

A combined mixing and deflection unit includes a flow conduit for a medium flowing in a given direction. The flow conduit has a bend region, a given direction downstream of the bend region as seen in the given flow direction, and a cross section. A guide configuration is disposed in the bend region for deflecting the flowing medium from a main flow direction. The guide configuration defines a plane aligned approximately parallel to the given direction downstream of the bend region. The guide configuration has openings formed therein being evenly distributed over the cross section of the flow conduit.

5 Claims, 2 Drawing Sheets

COMBINED MIXING AND DEFLECTION UNIT

BACKGROUND OF THE INVENTION

Field of the Invention

The invention relates to a combined mixing and deflection unit for a flowing medium, with a guide device and a flow conduit bent at a knee, kink or bend location.

So-called guide vanes which are known for deflecting a flowing medium, deflect the flowing medium from a first flow direction into a second desired flow direction which is different by a deflection angle alpha. For that purpose the guide vanes have a bent profile which initially is aligned parallel to the inflowing stream, then deflects the flow by means of a mostly curved section and then terminates in the direction of the desired flow. In that connection and particularly with guide vanes which have been installed in deflections with relatively small deflection angles, it is necessary to tolerate a disadvantage which is that the guide vanes must make the flow conduit "obscure to view" in the flow direction of the flowing medium in the region of the deflection, so that the guide vanes force a deflection of the flowing medium. In detail, that means that the guide vanes extend particularly far into the flow conduit located downstream of the deflection, which results in a particularly great space requirement in the region downstream of the guide vanes. Due to the great pressure difference between the downstream and upstream sides of the guide vane, particularly large regions exist in which particles contained in the flowing medium can settle, especially with guide vanes aligned at an angle relative to the direction of the force of gravity.

A multitude of static mixers are known for mixing a flowing medium. For example, static mixers are known from German Published, Non-Prosecuted Application DE 41 23 161 A1, which have a multitude of deflection elements evenly distributed over the cross section of the flow conduit. The dimensions of the deflection elements are small in comparison to the dimensions of the flow conduit and the deflection elements are disposed at an angle relative to the main flow direction of the flowing medium. Intensive mixing of the flowing medium locally and over the entire cross section of the flow conduit is achieved with such static mixers.

It is a disadvantage that it is not possible to achieve a change in the main flow direction of the flowing medium with such static mixers. However, if a change in the main flow direction and mixing of the flowing medium is desired, it is customary to use a deflection device, such as guide vanes, and additionally a mixing configuration, such as a static mixer. The space requirements for the deflection device and the mixing configuration can be greater than the space available in the flow conduit, particularly with deflections having small angles of deflection, i.e. with angles less than 90°.

SUMMARY OF THE INVENTION

It is accordingly an object of the invention to provide a combined mixing and deflection unit, which overcomes the hereinafore-mentioned disadvantages of the heretofore-known methods and devices of this general type and which provides a way in which a deflection and mixing of a flowing medium is to be performed with extremely little space requirements.

With the foregoing and other objects in view there is provided, in accordance with the invention, a combined mixing and deflection unit, comprising a flow conduit for a medium flowing in a given direction, the flow conduit having a bend region, a given direction downstream of the bend region as seen in the given flow direction, and a cross section; and a guide configuration being disposed in the bend region for deflecting the flowing medium from a main flow direction, the guide configuration defining a plane aligned approximately parallel to the given direction downstream of the bend region, and the guide configuration having openings formed therein being evenly distributed over the cross section of the flow conduit.

In this way, because of the alignment of the guide configuration, the flowing medium is deflected at least partially into the desired direction downstream of the bend region and the portion of the flowing medium which is not deflected is swirled at the edges of the openings. The deflected portion of the flowing medium and the swirled portion of the flowing medium are mixed in the region directly downstream of the combined mixing and deflection unit, so that the flowing medium flows off downstream of the bend region while being sufficiently deflected and sufficiently turbulent. Based on the even distribution of the openings, only small dead flow spaces occur on the downstream side (leeward side) of the guide configuration, so that a deposit of particles contained in the flowing medium is particularly small.

In accordance with another feature of the invention, in order to achieve sufficient deflection and mixing of the flowing medium, along with a simultaneous relatively small pressure drop, there is provided an obstruction ratio of approximately 0.35 to 0.65, and preferably 0.5, wherein the obstruction ratio is defined as a ratio of the surface of the opening to the total surface of the deflection configuration.

In accordance with a further feature of the invention, the guide configuration includes a plurality of evenly spaced guide vanes which are essentially disposed in one plane.

This provides a simple structural layout of the basic idea of the invention.

In accordance with an added feature of the invention, the guide vanes have a trapezoidal shape and are alternately aligned with their narrow and their wide edges towards the flow of the flowing medium.

In accordance with an additional feature of the invention, there are provided between four and ten of the guide vanes disposed in the flow conduit.

In accordance with yet another feature of the invention, the plane of the guide configuration is oriented in approximate alignment with the direction of gravity.

In accordance with yet a further feature of the invention, there is provided a location for adding a further flowing medium, for example ammonia $NH_3$, being disposed downstream of the guide configuration, as seen in the given flow direction of the flowing medium.

In accordance with a concomitant feature of the invention, there are provided means upstream of the guide configuration, as seen in the given flow direction of the flowing medium, for bringing a hotter portion of the flowing medium together with a cooler portion of the flowing medium.

Other features which are considered as characteristic for the invention are set forth in the appended claims.

Although the invention is illustrated and described herein as embodied in a combined mixing and deflection unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following descriprtion of specific embodiments when read in connection with the accompanying drawings.

DESCRIPTION OF THE PREFERRED EMBODIMENTS

Figure 1:
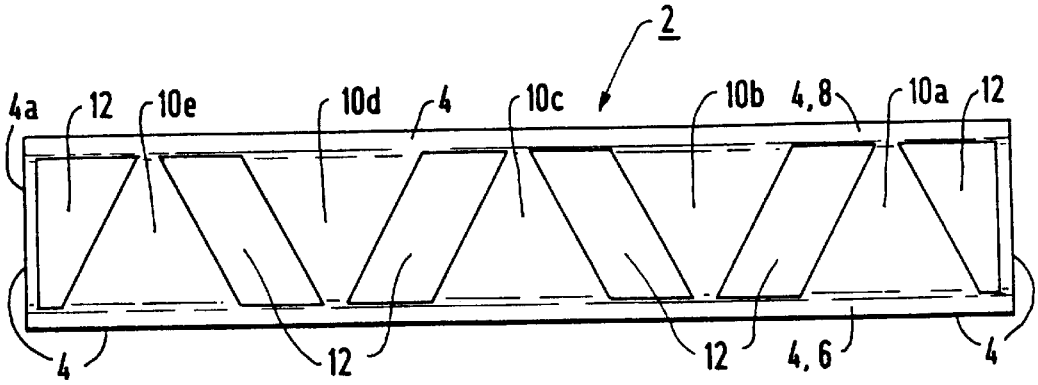
FIG. 1 is a diagrammatic plan view of a first guide configuration.

Referring now to the figures of the drawing in detail and first, particularly, to FIG. 1 thereof, there is seen a first guide configuration 2 in a plan view, which in this case is constructed as a guide plate 2. The guide plate 2 includes a metallic frame 4. The frame 4 has a rectangular base surface. Five trapezoidal guide vanes 10*a* to 10*e* have been installed between a first part of a long side, which is designated below as a leading edge 6, and a second part of a long side, which is designated below as a trailing edge 8. The guide vanes 10*a* to 10*e* are evenly spaced and are alternatingly fastened at their narrow and their wide sides to the leading or trailing edge 6, 8. Openings 12 are enclosed by the frames 4 and the guide vanes 10*a* to 10*e*. These openings 12 can be stamped-out openings. The guide vanes 10*a* to 10*e* can also be fastened to the frame 4 by welding. In the exemplary embodiment the guide plate 2 has an obstruction ratio of approximately 0.54. The obstruction ratio is defined as the ratio of the surface of the openings 12 to the entire surface of the guide plate 2. Viewing the surface in accordance with FIG. 1, the leading edge 6 and the trailing edge 8 are oppositely bent. This will become clear below by reference to FIG. 3. A transverse side of the frame 4 is designated by reference symbol 4*a*.

Figure 2:
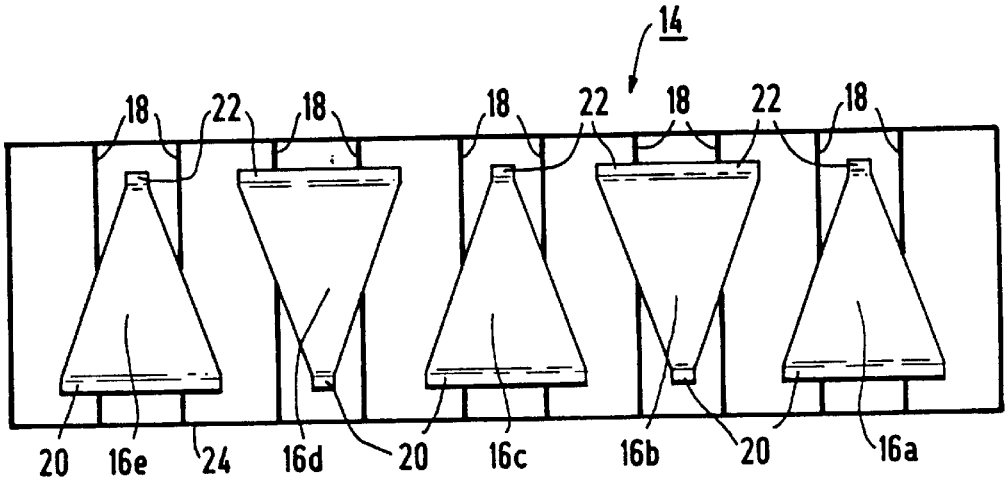
FIG. 2 is a plan view of a second guide configuration.

FIG. 2 illustrates a second guide configuration 14 which also includes five trapezoidal guide vanes 16*a* to 16*e*, that have been fastened by means of two support pipes 18 on opposite interior wall surfaces of a flow conduit 24. The respective guide vanes 16*a* to 16*e* have their own leading edges 20 and trailing edges 22 which are bent off in opposite directions. The obstruction ratio of this guide configuration 14 is approximately 60%. In FIGS. 1 and 2 the plane of the plate of the guide configuration 2, 14 constitutes a representational plane.

Figure 3:
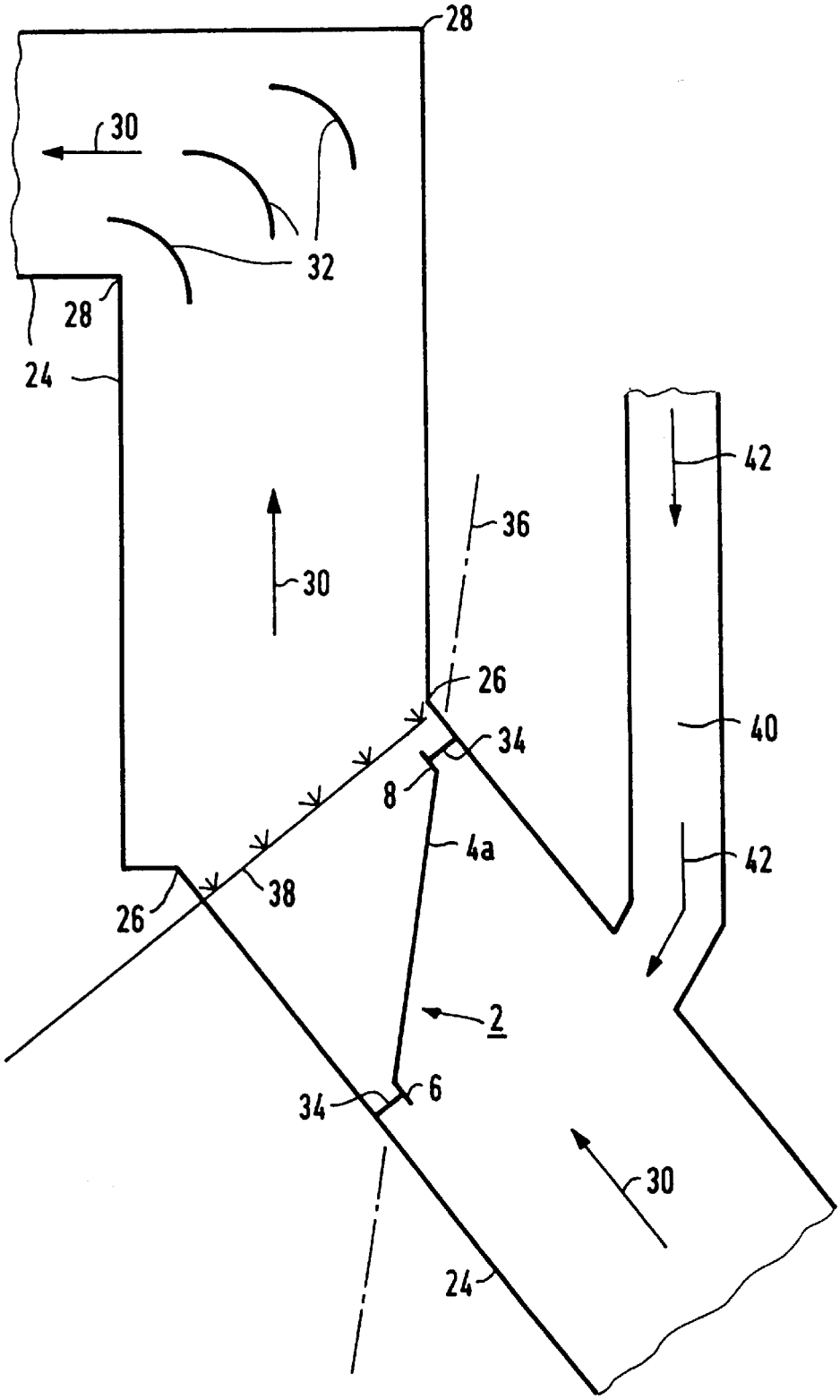
FIG. 3 is a fragmentary, sectional view of a flue gas conduit of a combustion installation.

FIG. 3 shows a diagrammatic representation of a section of a flue gas conduit 24 of a non-illustrated combustion installation. A bend, knee or kink region 26 and a 90° deflection 28 can be seen in the flue gas conduit 24. The deflection by 90° of flue gas 30, which is heavily laden with dust and nitrogen oxide, is performed by means of guide vanes 32 installed in the 90° deflection 28.

The guide plate 2 illustrated in FIG. 1 is installed in the bend region 26 in the flue gas conduit 24 on connecting pieces, in this case bar-shaped bases 34. A sectional view parallel to the transverse side 4*a* of the metallic frame 4 of FIG. 1 is shown in FIG. 3. A plane 36 of the guide plate 2 is aligned approximately parallel to a direction of flue gas 30 in a flow downstream of the bend region 26. The plane 36 of the guide plate 2 is also aligned approximately parallel to the direction of gravity, because of which a deposit of the dust contained in the flue gas 30 on the guide plate 2 is prevented to the utmost degree. In addition, an ammonia injection device 38 is installed in the bend region 26, by means of which ammonia gas can be supplied to the flue gas 30 which is subsequently used for the catalytic reaction of the nitrogen oxide in a deNOx installation. A bypass conduit 40 terminates in the flue gas conduit 24 in a region of the flue gas conduit 24 upstream of the guide plate 2. In the exemplary embodiment, a portion 42 of the flue gas, which was previously divided off from the remaining flue gas 30, flows through the bypass conduit 40. The portion 42 flowing through the bypass conduit 40 can be considerably hotter than the flue gas 30 flowing through the flue gas conduit 24, for example because the heat contents of the latter had previously been used for steam generation in a non-illustrated waste heat boiler.

In the course of operation of the non-illustrated combustion installation, the guide plate 2 installed in the bend region 26 fulfills three functions simultaneously. Firstly, in accordance with the alignment of its guide vanes 10*a* to 10*e*, the guide plate 2 provides a deflection of the flue gas 30 into the flow direction of the flue gas 30 downstream of the bend region 26. Secondly, the flue gas deflected by means of the guide vanes 10*a* to 10*e* is deflected around the edges of the guide vanes 10*a* to 10*e* over turbulent flow paths, by means of which a mixing of the hot portions 42 with the remaining flue gas 30 is achieved. Thirdly, the turbulent flows generated by means of the guide plate 2 cause the ammonia gas injected directly in the bend region 26 to be mixed homogeneously with the flue gas 30.

The pressure drop caused by the guide plate 2 which is placed at an angle relative to the main flow direction is only approximately 1.0 mbar. This small pressure drop is so low because in the exemplary embodiment only five guide vanes 10*a* to 10*e* have been placed almost parallel to the flow direction of the flue gas 30 downstream of the bend region 26. In general a number of from four to ten guide vanes per guide plate 2 is sensible. As was already shown, by means of such a distribution there is a negligible pressure drop as well as a sufficiently satisfactory mixing and deflection of the flue gas 30 in the region of the bend location 26.

The guide configuration 14 illustrated in FIG. 2 could have been installed at this location in the flow conduit 24, similar to the guide plate 2 illustrated in FIG. 1. For this purpose, fastening of the support pipes 18 directly on the interior wall surfaces of the flue gas conduit 24 is conceivable. The support pipes 18 could just as well be fastened on the bases 34 shown in FIG. 3. The shape of the guide vanes 10*a* to 10*e*, 16*a* to 16*e* can also be rectangular, triangular, semi-circular or semi-elliptical.

What is claimed is:

1. A combined mixing and deflection unit, comprising:

a flow conduit having a bend region defining an upstream flow direction and a downstream flow direction different from the upstream flow direction, said flow conduit conducting a medium; and a guide configuration disposed in said bend region for deflecting the flowing medium from the upstream flow direction to the downstream flow direction, said guide configuration being aligned in a plane approximately parallel to said downstream flow direction, said guide configuration having openings formed therein being evenly distributed over said guide configuration and having a plurality of evenly spaced guide vanes being substantially disposed in said plane, said guide vanes being trapezoidal and having narrow and wide edges being alternatingly aligned toward the flow of the flowing medium.

2. The combined mixing and deflection unit according to claim 1, wherein between four and ten of said guide vanes are disposed in said flow conduit.

3. A combined mixing and deflection unit, comprising:

a flow conduit having a bend region defining an upstream flow direction and a downstream flow direction different from the upstream flow direction, said flow conduit conducting a medium;

a guide configuration disposed in said bend region for deflecting the flowing medium from the upstream flow direction to the downstream flow direction, said guide configuration being aligned in a plane approximately parallel to said downstream flow direction, and said guide configuration having openings formed therein being evenly distributed over said guide configuration; and a location for adding a further flowing medium, being disposed downstream of said guide configuration.

4. A combined mixing and deflection unit, comprising:

a flow conduit having a bend region defining an upstream flow direction and a downstream flow direction different from the upstream flow direction, said flow conduit conducting a medium;

a guide configuration disposed in said bend region for deflecting the flowing medium from the upstream flow direction to the downstream flow direction, said guide configuration being aligned in a plane approximately parallel to said downstream flow direction, and said guide configuration having openings formed therein being evenly distributed over said guide configuration; and a location for adding a flow of ammonia, being disposed downstream of said guide configuration.

5. A combined mixing and deflection unit, comprising:

a flow conduit having a bend region defining an upstream flow direction and a downstream flow direction different from the upstream flow direction, said flow conduit conducting a medium;

a guide configuration disposed in said bend region for deflecting the flowing medium from the upstream flow direction to the downstream flow direction, said guide configuration being aligned in a plane approximately parallel to said downstream flow direction, and said guide configuration having openings formed therein being evenly distributed over said guide configuration; and means upstream of said guide configuration, as seen in said given flow direction of the flowing medium, for bringing a previously separated-out portion of the flowing medium together with the flowing medium.

* * * * *